US005778783A

United States Patent [19]

Compera et al.

[11] Patent Number: 5,778,783

[45] Date of Patent: Jul. 14, 1998

[54] SHEET-FED PRINTING PRESS

[75] Inventors: Christian Compera, Dossenheim; Martin Greive, Heidelberg; Bernd Herrmann, Malsch; Anton Rodi, Leimen, all of Germany

[73] Assignee: Heidelberger Druckmaschinen AG, Heidelberg, Germany

[21] Appl. No.: 686,817

[22] Filed: Jul. 26, 1996

[30] Foreign Application Priority Data

Jul. 26, 1995 [DE] Germany ..... 195 27 266.8

[51] Int. Cl.[6] ..... B41F 13/24

[52] U.S. Cl. ..... 101/232; 101/247

[58] Field of Search ..... 101/230, 137, 101/229, 211, 247, 232, 231, 177; 400/583

[56] References Cited

U.S. PATENT DOCUMENTS

| | | | |
|---|---|---|---|
| 3,646,325 | 2/1972 | George | 101/230 |
| 4,250,806 | 2/1981 | Boyson et al. | 101/86 |
| 4,493,255 | 1/1985 | Fischer . | |
| 4,512,255 | 4/1985 | Crist | 101/230 |
| 4,711,172 | 12/1987 | Capdebosc | 101/152 |
| 4,717,270 | 1/1988 | Tsutsumi | 400/583 |
| 5,001,500 | 3/1991 | Wolfberg et al. | 347/154 |
| 5,016,529 | 5/1991 | Jahn | 101/211 |
| 5,195,738 | 3/1993 | Gysling | 271/111 |
| 5,259,308 | 11/1993 | Wirz | 101/230 |
| 5,406,884 | 4/1995 | Okuda et al. | 101/137 |
| 5,467,710 | 11/1995 | Wirz | 101/230 |
| 5,499,093 | 3/1996 | Aerens et al. | 101/211 |
| 5,526,107 | 6/1996 | Brownstein | 347/262 |
| 5,608,639 | 3/1997 | Twardowski et al. | 101/483 |

FOREIGN PATENT DOCUMENTS

| | | |
|---|---|---|
| 234 969 | 5/1911 | Germany . |
| 32 03 879 C2 | 8/1983 | Germany . |
| 39 06 630 A1 | 9/1989 | Germany . |
| 42 19 116 A1 | 12/1993 | Germany . |
| 43 03 797 A1 | 8/1994 | Germany . |

*Primary Examiner*—Eugene H. Eickholt
*Attorney, Agent, or Firm*—Herbert L. Lerner; Laurence A. Greenberg

[57] ABSTRACT

A sheet-fed printing press includes a plurality of printing units disposed along a sheet-transport path. A transport apparatus (3, 33, 40, 50, 66, 78) is disposed along the sheet-transport path. The sheets are transported through the printing units along the sheet-transport path and, after recto-printing, they are returned along a return-transport path which extends essentially in an opposite direction to the sheet-transport path. The printing press is thus enabled to print recto-and-verso while having a very short structural length.

9 Claims, 9 Drawing Sheets

SHEET-FED PRINTING PRESS

BACKGROUND OF THE INVENTION

FIELD OF THE INVENTION

The invention relates to a sheet-fed printing press with a plurality of printing units disposed in-line along a sheet-transport path.

In order to be able, with such a printing press, to perform recto and verso printing in one operation, it has been known to dispose a turning device between two of the in-line printing units. Recto printing takes place before the turning device and verso printing takes place after the turning device. Such a printing press must comprise just as many printing units as the total number of colors of both sides of the sheet and, consequently, it has a large overall length.

SUMMARY OF THE INVENTION

It is accordingly an object of the invention to provide a sheet-fed printing press with a plurality of printing units, which overcomes the above-mentioned disadvantages of the heretofore-known devices and methods of this general type and which is suitable for consecutive recto and verso printing and has as small an overall length as possible.

With the foregoing and other objects in view there is provided, in accordance with the invention, a sheet-fed printing press, comprising: a plurality of printing units disposed along a sheet-transport path; and a transport apparatus disposed along the sheet-transport path, the transport apparatus transporting sheets through the printing units along the sheet-transport path and returning the sheets along a return-transport path defined substantially in an opposite direction to the sheet-transport path.

In accordance with an added feature of the invention, the printing units are digital printing units and the transport apparatus returns the sheets, after having been recto-printed in the printing units, in turned position for transporting the sheets along the sheet-transport path for verso printing in the same the printing units.

In accordance with an additional feature of the invention, the printing units are adapted to be operated at a faster rate than a feeder of the printing press.

In accordance with another feature of the invention, the above-mentioned printing units are recto printing units, and there are provided further printing units for verso printing disposed along the return-transport path.

In accordance with a further feature of the invention, a turning apparatus is disposed at a junction of the sheer-transport path and the return-transport path.

In accordance with again an added feature of the invention, the transport apparatus consists essentially of a single transport apparatus transporting the sheets along the sheer-transport path and along the return-transport path. As an alternative embodiment, the transport apparatus comprises a sheet-transport apparatus transporting the sheets along the sheet-transport path, and a return-transport apparatus, separate from the sheet-transport apparatus, for returning the sheets along the return-transport path.

In accordance with again an additional feature of the invention, there is provided an inspection-sheet receiver disposed along the return-transport path.

In accordance with again another feature of the invention, the transport apparatus defines the sheet-transport path and the return-transport as substantially rectilinear paths extending approximately parallel at a distance from one another.

In accordance with yet another feature of the invention, the printing units include transfer cylinders with a given diameter for transferring printed images onto the sheets, the transfer cylinders including a first row of transfer cylinders for recto-printing on one side of the sheets, the transfer cylinders of the first row of transfer cylinders being disposed in-line and mutually spaced apart by a distance smaller than the given diameter, and a second row of transfer cylinders for verso-printing another side of the sheet, the transfer cylinders of the second row of transfer cylinders being disposed in-line and mutually spaced apart by a distance smaller than the given diameter, the first and second rows being offset relative to one another and each transfer cylinder of the first row contacting at least one the transfer cylinder of the second row.

In accordance with a concomitant feature of the invention, there are provided two impression cylinders with a much larger diameter than transfer cylinders of the printing units, a plurality of the plurality of printing units being disposed in-line at a circumference of each of the two impression cylinders, the sheet-transport path being defined between the printing units and a respective the impression cylinders and extending substantially along an S-shaped path around the impression cylinders.

In other words, the objects of the invention are satisfied with a transport apparatus which returns the sheets after they have been transported along the sheet-transport path, via a return-transport path which is directed essentially in the opposite direction to the sheet-transport path.

In the case of conventional printing units, further printing units are disposed along the return-transport path. On which side of the returning sheets the further printing units are disposed depends on whether the sheets are turned from one side to the other at the place of transport-direction reversal or whether they are returned in more or less the same position. The latter alternative is particularly suitable for thicker paper and carton. Return-transport can either be carried out by the same transport apparatus that transports the sheets for recto printing, or a separate return-transport apparatus is used, this permitting the modular construction of the printing press.

In the case of digital printing units, in which the impression surface is reimaged in real-time and the ink is transferred onto the paper sheet in its entirety (e.g. a new printed image is possible for each sheet), it is possible to employ either the aforementioned embodiment with further printing units or an embodiment in which, apart from the printing units along the sheet-transport path, no further printing units are required.

For this purpose, the return-transport path is set up in such a manner that the returning sheets are directed back, in turned position, onto the sheet-transport path for verso printing by means of the same printing units, and the printing units are operated at a faster rate than the feeder.

In a preferred embodiment, the speed of the printing units is twice that of the feeder, the feeder supplying the transport apparatus with one new sheet for recto printing between every two returning sheets for verso printing. Alternatively, any desired number of sheets may be consecutively printed, recto-only (e.g. three sheets). Then a further number of sheets (e.g. a single sheet) are printed recto-and-verso. For example, the single sheet, having been recto-printed, is returned via the return-transport apparatus and, in order to be verso-printed, is then re-supplied to the transport apparatus between successive groups of three of the sheets that are to be printed consecutively on the recto side.

Since, nowadays, the printing-press speed is frequently limited by the maximum possible rate of the feeder, this embodiment permits better utilization of the system resources if the printing units are able to operate faster than the feeder.

Also in the embodiment with digital printing units, the return transport can be effected by the transport apparatus itself or by a separate return-transport apparatus.

Through activation and deactivation of return transport, the printing press can be switched in a simple manner between recto printing and verso printing. A suitable arrangement of the return-transport path further permits inspection sheets to be diverted into an inspection-sheet receiver in such a manner that the inspection sheets can be conveniently removed or, without being taken out of the inspection-sheet receiver, can be assessed by the press operator. It is possible to remove either completely printed sheets or sheets that have only been recto-printed.

The aforementioned embodiments are particularly suitable for a rectilinear sheet-transport path, the return-transport path preferably extending more or less parallel to the sheer-transport path.

A further printing press may be realized with a plurality of printing units, which are enabled for both recto and verso printing and which are of small overall length. In that case, the printing units comprise transfer cylinders for transferring printed images onto the sheets, with a first row of transfer cylinders for one side of the sheet disposed in-line and spaced apart by a distance smaller than the cylinder diameter, and with a second row of transfer cylinders for the other side of the sheet disposed in-line and spaced apart by a distance smaller than the cylinder diameter. The two rows are thereby offset relative to each other and each transfer cylinder of the first row contacts at least one transfer cylinder of the second row, in order to serve as counter-pressure impression cylinder.

This results in a snaking sheet-transport path that is extremely short for a given number of transfer cylinders. The sheets are conveyed along the sheet-transport path by friction between the transfer cylinders, with the result that no sheer-transport means whatsoever are required between the transfer cylinders.

A further printing press with a plurality of printing units for recto-and-verso printing and of minimum overall length can be realized according to the invention. Two impression cylinders are provided with a considerably larger diameter than the printing units or than transfer cylinders of the printing units. A plurality of printing units or transfer cylinders thereof are disposed in-line at the circumference of each of the two impression cylinders. The sheet-transport path passes between the printing units and the respective impression cylinders and extends essentially in an S shape around the two impression cylinders.

Other features which are considered as characteristic for the invention are set forth in the appended claims.

Although the invention is illustrated and described herein as embodied in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
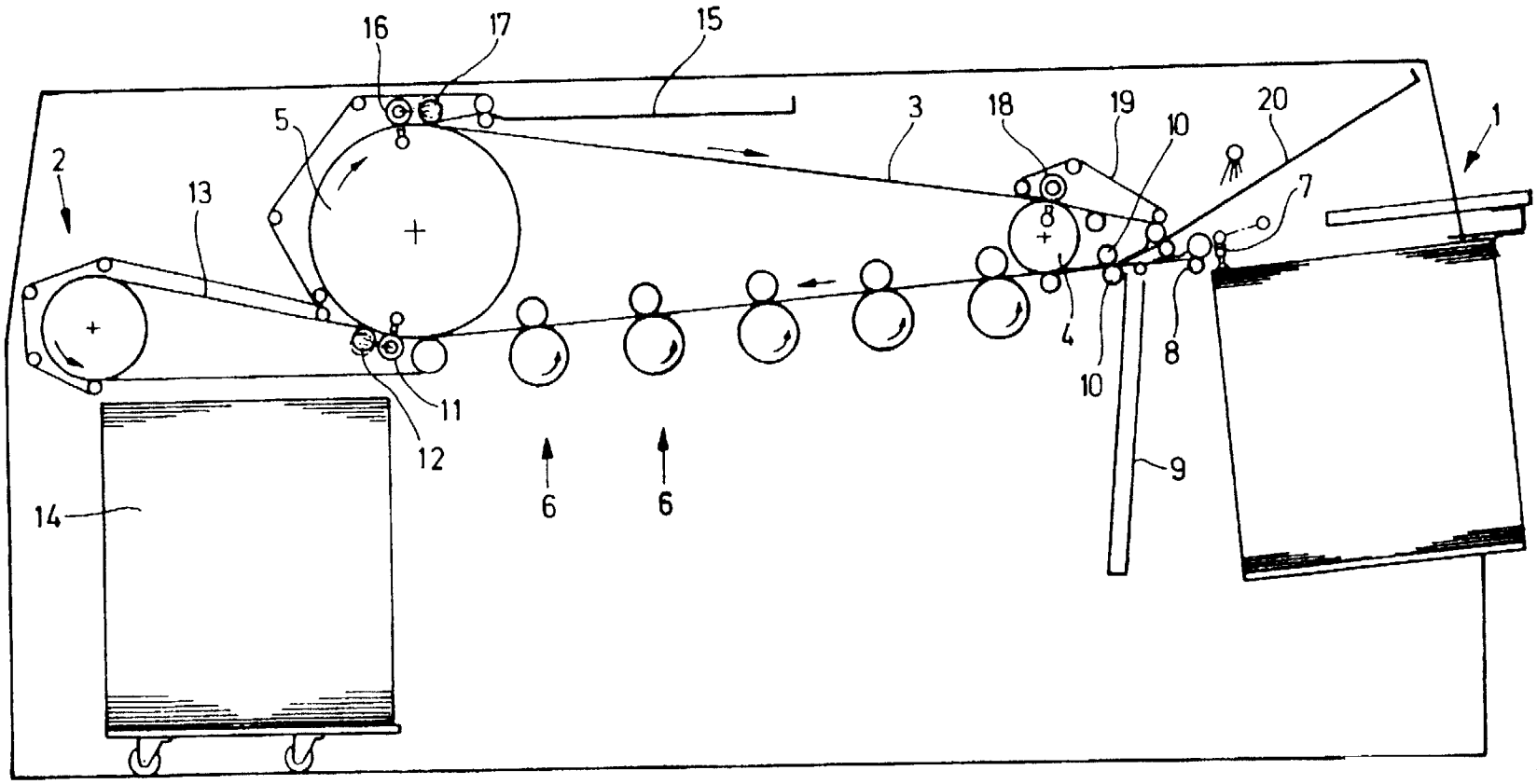
FIG. 1 is a partly-sectional side view of a printing press for five-color recto-and-verso printing with five printing units.

Referring now to the figures of the drawing in detail and first, particularly, to FIG. 1 thereof, there is seen a printing press, which includes a feeder 1, a delivery 2, and a conveyor belt 3. The conveyor belt 3 passes around a feeder-side guide roller 4 and a delivery-side guide roller 5, it is held taut by the rollers 4, 5 and it is driven by them in the direction indicated by an arrow. The printing press further includes five digital printing units 6, which are disposed directly in-line along the side of the conveyor belt 3 running from the feeder 1 to the delivery 2.

A sucker 7 and feeder rollers 8 are situated at the top edge of a sheet pile in the feeder 1. Between the feeder rollers 8 and the side of the conveyor belt 3 running from the feeder 1 to the delivery 2 there is disposed a diverting ejector, which communicates with a double-sheet pocket 9, and conveying rollers 10.

A suction roller 11 and an idler roller 12, swivelable towards the roller 5, are mounted at a location at which the side of the conveyor belt 3 running from the feeder 1 to the delivery 2 contacts the delivery-side roller 5. A delivery transport belt 13 passes between the suction roller 11 and the idler roller 12, on one side, and the roller 5, on the other side. The delivery transport belt 13 passes over a pile 14 of the delivery 2.

A further suction roller 16 and a further idler roller 17 are disposed between a location at which the conveyor belt 3 still tangentially contacts the roller 5, i.e. on the delivery side of the returning side of the conveyor belt 3, and an inspection-sheet pocket 15 disposed above the returning side of the conveyor belt 3.

A further suction roller 18 and a transfer belt 19 are disposed at a location at which the returning side of the conveyor belt 3 lands on the feeder-side roller 4. The transfer belt 19 communicates with an obliquely lying turning pocket 20. The lower end of the turning pocket 20 points towards the nip of the conveying rollers 10.

During the operation of the printing press of FIG. 1, the sheets on the feeder 1 are separated and picked up singly by the sucker 7 and are placed between the feeder rollers 8. The feeder rollers 8 accelerate the sheets towards the conveying rollers 10. Double sheets are detected by a non-illustrated sensor and they are ejected into the double-sheet pocket 9.

The singled sheets are conveyed onto the conveyor belt 3 by the conveying rollers 10, the sheets being held on the surface of the conveyor belt 3 by suction-gripping or by electrostatic forces. The conveyor belt 3 transports the sheets along the printing units 6 to the delivery 2.

If recto-only printing is being performed, the suction roller 11 which contacts the conveyor belt 3 on the delivery-side roller 5 is activated, with the result that the sheets are directed onto the delivery transport belt 13, from where they are conveyed onto the delivery pile 14.

If the sheets are to be recto-and-verso printed, the printing units 6 and the conveyor belt 3 are operated at a speed corresponding to twice the rate of the feeder 1. In a first pass the sheets supplied from the feeder 1 are printed on one side by the printing units 6 and the sheets printed on one side are held on the conveyor belt 3 by pressure of the idler roller 12 against the roller 5. The conveyor belt 3 returns the one-sided printed sheets on its upper side back towards the delivery 2 and deposits them into the turning pocket 20. From the turning pocket 20 they are returned in the opposite direction and turned upside down (as compared to the first recto printing run) onto the conveyor belt 3 via the conveying rollers 10. The one-sided printed sheets are fed into the spaces between the new sheets from the feeder 1 (zipper-type merging); the spaces result from the fact that the feeder 1 is operated at a rate corresponding to half the speed of the conveyor belt 3. Furthermore, it is possible, through the intermediary of the turning pocket 20, to feed individual sheets into the on-going printing process, e.g. book covers.

In the second pass, the sheets printed on one side are printed on the other side by the correspondingly controlled digital printing units 6, which allow a new printed image on each sheet. The sheets—now having been printed on both sides—are directed by the suction roller 11 into the delivery 2, while the intermediate sheets, which have been printed on the first side by the printing units 6, are held on the conveyor belt 3 by the idler roller 12. Consequently, in this recto-and-verso printing mode, the suction roller 11 and the idler roller 12 are operated in alternation and they form an alternately controlled sheet diverter.

If the output of an inspection sheet is desired, the suction roller 11 or the idler roller 12 and the suction roller 16 or the idler roller 17 before the inspection-sheet pocket 15, which form a further sheet diverter, are, moreover, controlled in such a manner that an inspection sheet is ejected, with the desired printed side up, into the inspection-sheet pocket 15. The inspection-sheet pocket 15 is open at the top. Accordingly, the sheets can easily be removed or they can be assessed by the printer without taking them out of the inspection-sheet pocket 15.

The illustrated printing press can be switched from recto printing to verso printing, whereby the same printing units are used for both recto printing and verso printing. Only as many printing units are required as the maximum number of colors required for one side. Consequently, the total length of the printing press, which is essentially determined by the printing units disposed along a flat transport path, is minimal.

In the printing press embodiment shown in FIG. 1, the return transport of the sheets for verso printing is carried out using the same transport means that transports the sheets through the printing units. In contrast, FIG. 2 shows a printing press with a separate, removable return-transport apparatus.

Figure 2:
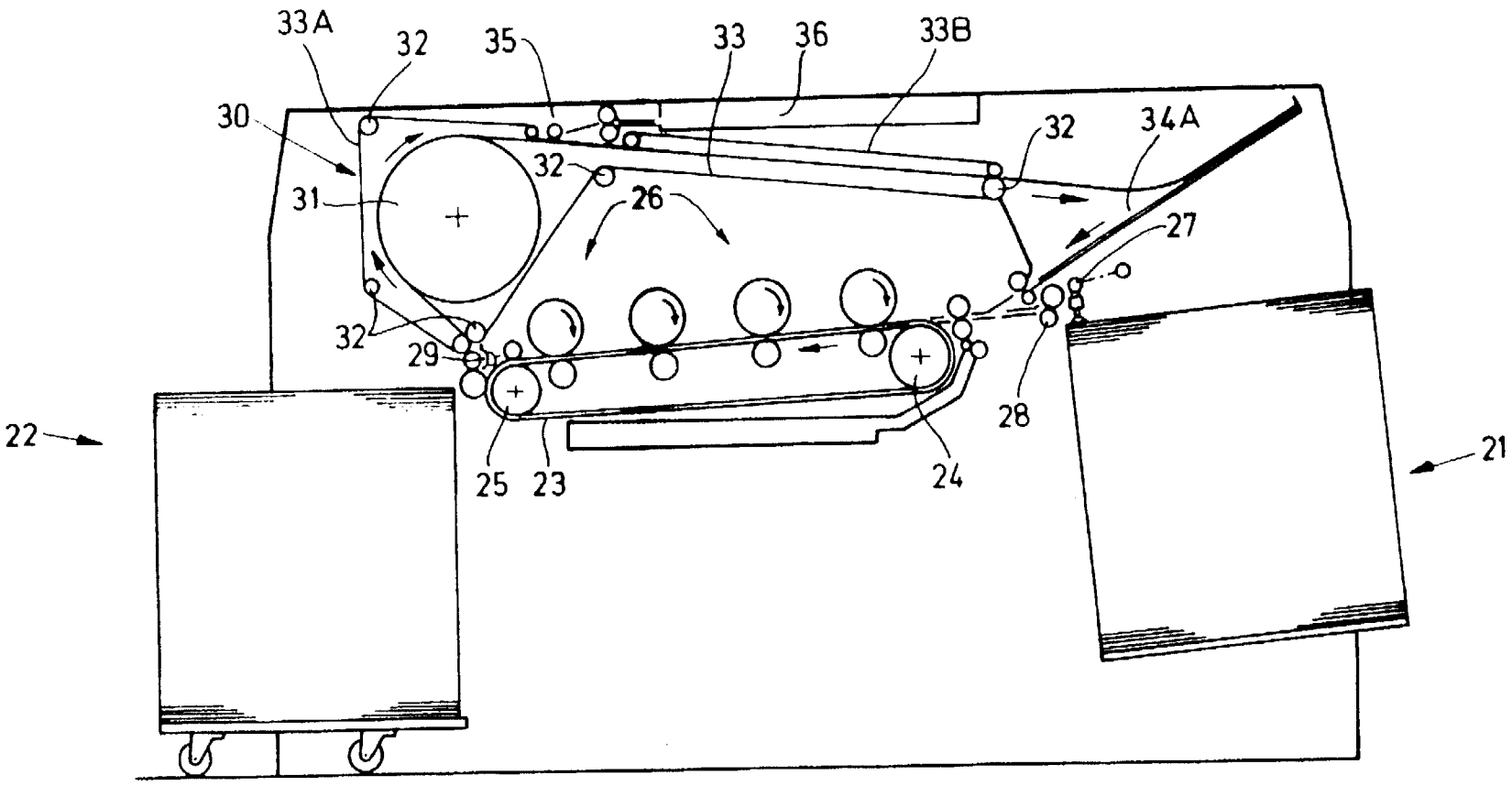
FIG. 2 is a similar view of a printing press for four-color recto-and-verso printing with four printing units and a removable return-transport apparatus.

FIG. 2 shows a printing press with a feeder 21, a delivery 22, and a conveyor belt 23. The conveyor belt 23 is deflected around a feeder-side guide roller 24 and a delivery-side guide roller 25, it is kept taut by the rollers, and it is driven by them in the direction indicated by an arrow. The printing press further includes four digital printing units 26 disposed directly in-line along the side of the conveyor belt 23 running from the feeder 21 to the delivery 22. This arrangement differs from the arrangement shown in FIG. 1 essentially in the fact that the returning side of the conveyor belt 23 is situated not above, but below the printing units 26.

Furthermore, the printing press in FIG. 2, just like the one in FIG. 1, comprises a sucker 27 and rollers 28 on the feeder 22 and a lower sheet diverter 29, which is connected to the conveyor belt 23 on the delivery side. The sheet diverter 29 is equivalent in function to the sheet diverter diagrammatically illustrated in FIG. 1 (formed by the suction roller 11 and the idler roller 12).

A verso-printing unit 30 extends above the printing units 26 between the feeder 21 and the delivery 22. The verso-printing unit 30 forms a return-transport apparatus for the sheets. The verso-printing unit 30 contains a deflecting drum 31, which is disposed in the vicinity of the delivery 22, and a plurality of idler rollers 32, which are disposed in such a manner that a return-transport belt 33 with two back-pressure belts 33A and 33B—the return-transport belt 33 being guided around the deflecting drum 31 and over the idler rollers 32 and being kept tensioned thereby—passes both the delivery side of the conveyor belt 23 and also the region of the feeder 21 when the return-transport belt 33 is driven, for example in that the deflecting drum 32 is driven.

In addition, the verso-printing unit 30 includes—on an upper side of the return-transport belt 33—an upper sheet diverter 35, which is controllable in order to direct sheets from the return-transport belt 33 onto an inspection-sheet receiver 36. At the feeder 21, the verso-printing unit 30 joins into a turning pocket 34A. Sheets transported in the direction of the arrows (towards the right) on the return-transport belt 33 are placed into the turning pocket 34. The sheets are then returned from the turning pocket 34 onto the conveyor belt 23.

With the printing press in FIG. 2 in recto-and-verso printing mode, the sheets are transported from the feeder 21 by the conveyor belt 23 through the printing units 26, where their recto side is printed, and on to the delivery 22. Having been printed on the recto side, the sheets are directed by the lower sheet diverter 29 into the verso-printing unit 30. The verso-printing unit turns and returns the sheets, similarly to the printing press in FIG. 1, onto the conveyor belt 23. The latter is operated at a speed equivalent to twice the rate of the feeder 21. The sheets—in their second pass through the printing units 26—are printed on the verso side and then being output to the delivery 22 by the sheet diverter 29.

An inspection sheet is output in the same manner as in the printing press in FIG. 1 through suitable controlling of the upper sheet diverter 35 or of the lower sheet diverter 29. It is even possible to divert a recto-and-verso printed sheet for inspection in the inspection bin 36. Generally, of course, recto-and-verso printed sheets may be inspected at the delivery 22.

Figure 3:
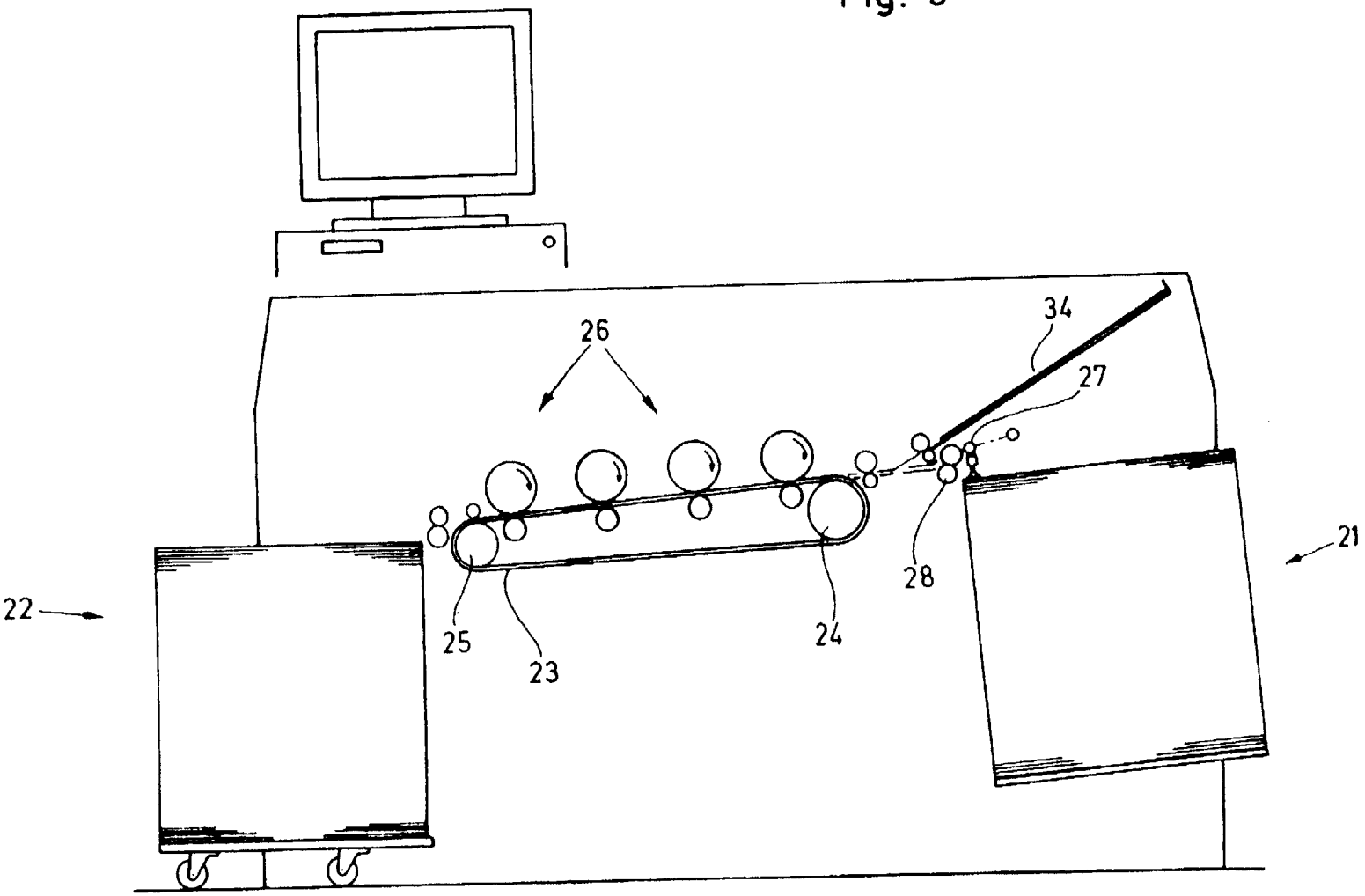
FIG. 3 is a similar view of the printing press of FIG. 2, with the return-transport apparatus removed.

The verso-printing unit 30 is removable, together with the sheet diverter 29, from the printing press shown in FIG. 2. The printing press shown in FIG. 3 is the same printing press as that of FIG. 2, but without the verso-printing unit 30. In this configuration, which is suitable for recto printing, it is possible for single sheets to be fed in via the turning pocket 34. FIG. 3, therefore, illustrates a digital printing press of modular construction that can be upgraded from recto printing to recto-and-verso printing (FIG. 2). The resulting printing press is just as compact in construction as the printing press shown in FIG. 1.

In addition, the printing press of FIG. 3 is quite suitable for the processing of very thick or stiff materials, such as glass, foils, cardboard, sheet metal etc., since, owing to the arrangement of the feeder 21, the delivery 22, and the intermediate printing units 26, the sheets are moved on a substantially rectilinear path. The result, of course, is that there is no deformation of the sheets. In the present case, the path is, slightly downwardly inclined, for ergometric reasons, but it may also be horizontal.

Figure 4:
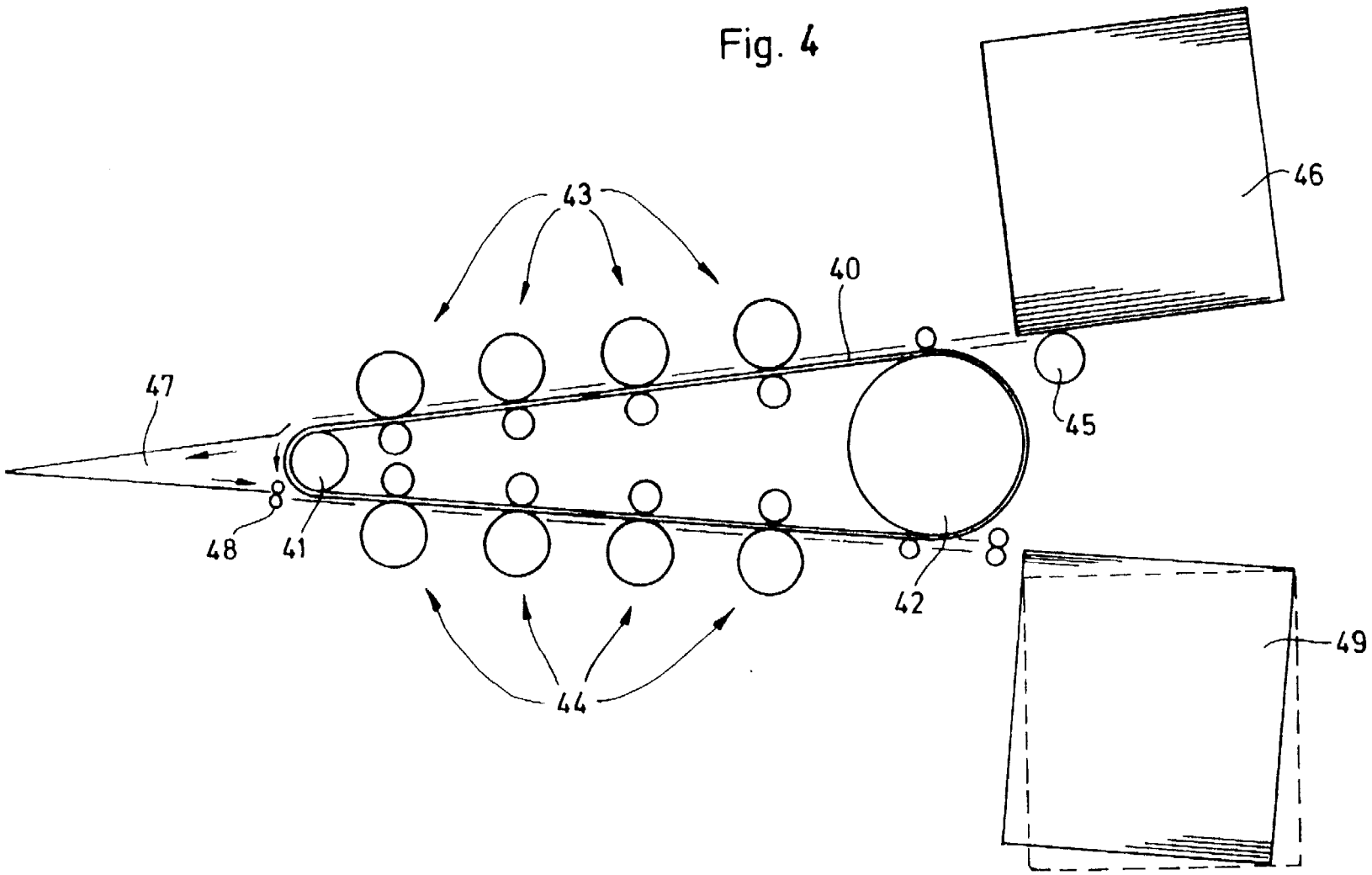
FIG. 4 is a schematic side view of a printing press for four-color recto-and-verso printing with eight printing units.

FIG. 4 is a schematic illustration of a further development of the printing press of FIG. 3. The press system of FIG. 4 permits simultaneous recto-and-verso printing without sheet deformation, yet requiring only a small overall length. An endless conveyor belt 40 is deflected about a first roller 41 and about a second roller 42 disposed at a distance from the first roller 41. The belt 40 is thereby kept tensioned and driven. The first roller 41 has a smaller diameter than the second roller 42 and the axes of the rollers 41 and 42 lie in the same horizontal plane. Four upper printing units 43 are disposed in-line along the upper side of the conveyor belt 40 between the rollers 41 and 42, and four lower printing units 44 are disposed in-line along the lower side of the conveyor belt 40 between the rollers 41 and 42.

A suction roller 45 draws sheets from the bottom of a feeder pile 46 and conveys them above the second roller 42 onto the conveyor belt 40, on which they are held, for example, by suction from the inside. On the first roller 41, owing to the curvature of the first roller 41 or because of the fact that no suction effect is produced on the circumference of the first roller 41, the sheets become detached from the first roller 41 and fall rectilinearly into a turning pocket 47, which is disposed on the opposite side of the feeder pile 46 in an extension of the upper and lower sides of the conveyor belt 40. From the turning pocket 47 the sheets are conveyed by conveying rollers 48 onto the lower side of the conveyor belt 40, which conveys them rectilinearly onto a delivery pile 49, which is situated, as viewed from the turning pocket 47, behind the second roller 42 or below the feeder pile 46. The feeder pile 46 and the delivery pile 49 are inclined according to the respectively adjoining side of the conveyor belt 40, with the result that there is no sheet deformation whatsoever at transfer. The delivery pile 49 may likewise be disposed horizontally, as is indicated by the broken line in FIG. 4.

The printing units 43, 44 each print the outsides of the sheets that pass by them on the conveyor belt 40, with the result that there is four-color recto printing on the upper printing units 43 and four-color verso printing on the lower printing units 44, without the sheets thereby being deformed.

Nevertheless, the printing-press arrangement shown has a short overall length, since the two rows of printing units 43, 44 are situated one above the other.

Figure 5:
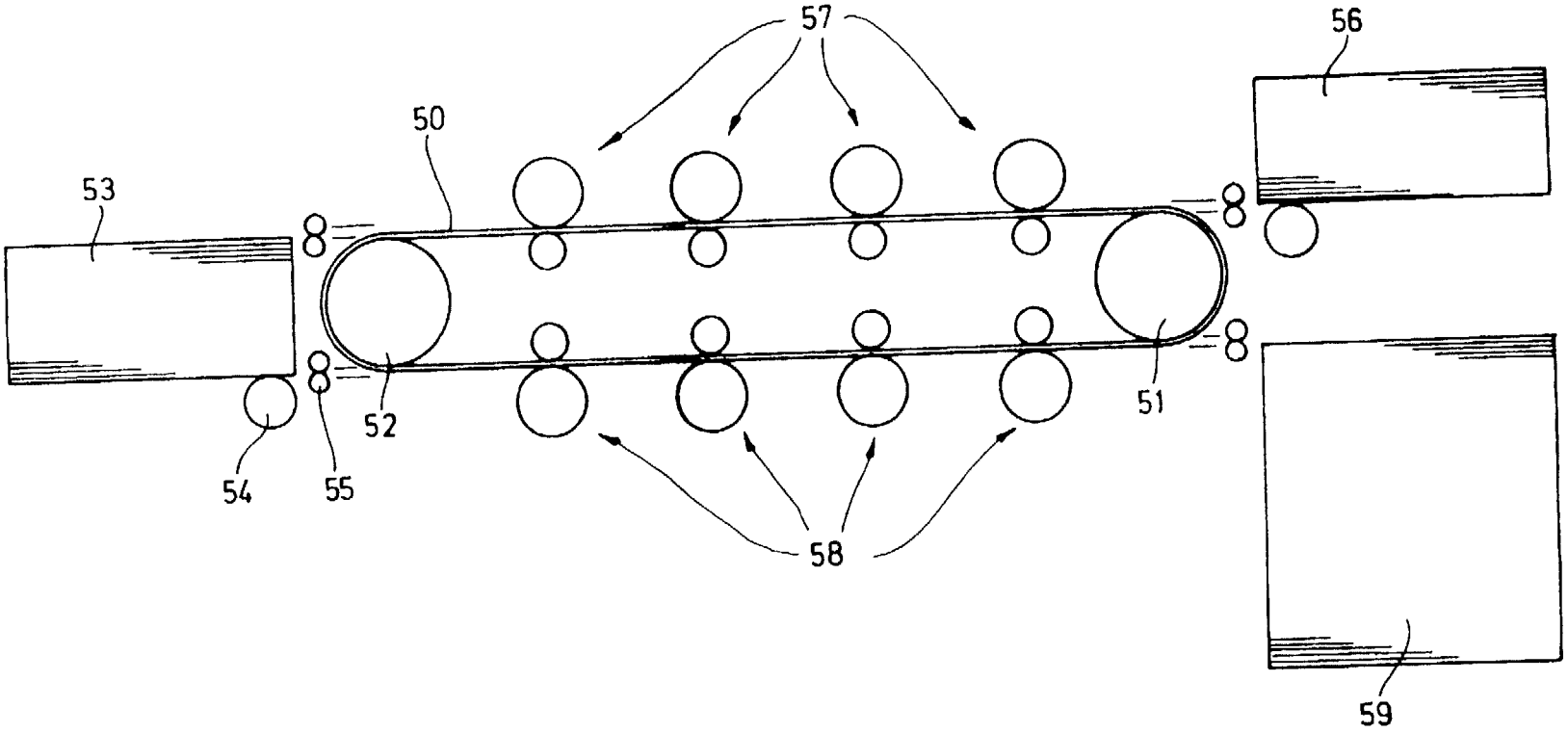
FIG. 5 is a similar view of a variant of the printing press shown in FIG. 4.

The printing press shown schematically in FIG. 5 differs from that of FIG. 4 in that guide rollers 51 and 52 around which a conveyor belt 50 is deflected, have identical diameters and in that, instead of the single sheet turning pocket 47, there is provided a further delivery on which a pile 53 is formed. In recto printing mode the sheets are deposited on the pile 53, while, in recto-and-verso printing mode, they are only intermediately stored on the pile 53 and are drawn from the bottom of the pile by a suction roller 54 and are returned via conveying rollers 55 onto the conveyor belt 50. A feeder pile 56, upper printing units 57, lower printing units 58 and a delivery pile 59, on which the finished printed products are deposited in recto-and-verso printing mode, are disposed essentially in the same manner as the feeder pile 46, the upper and lower printing units 43, 44 and the delivery pile 49 in FIG. 4.

Figure 6:
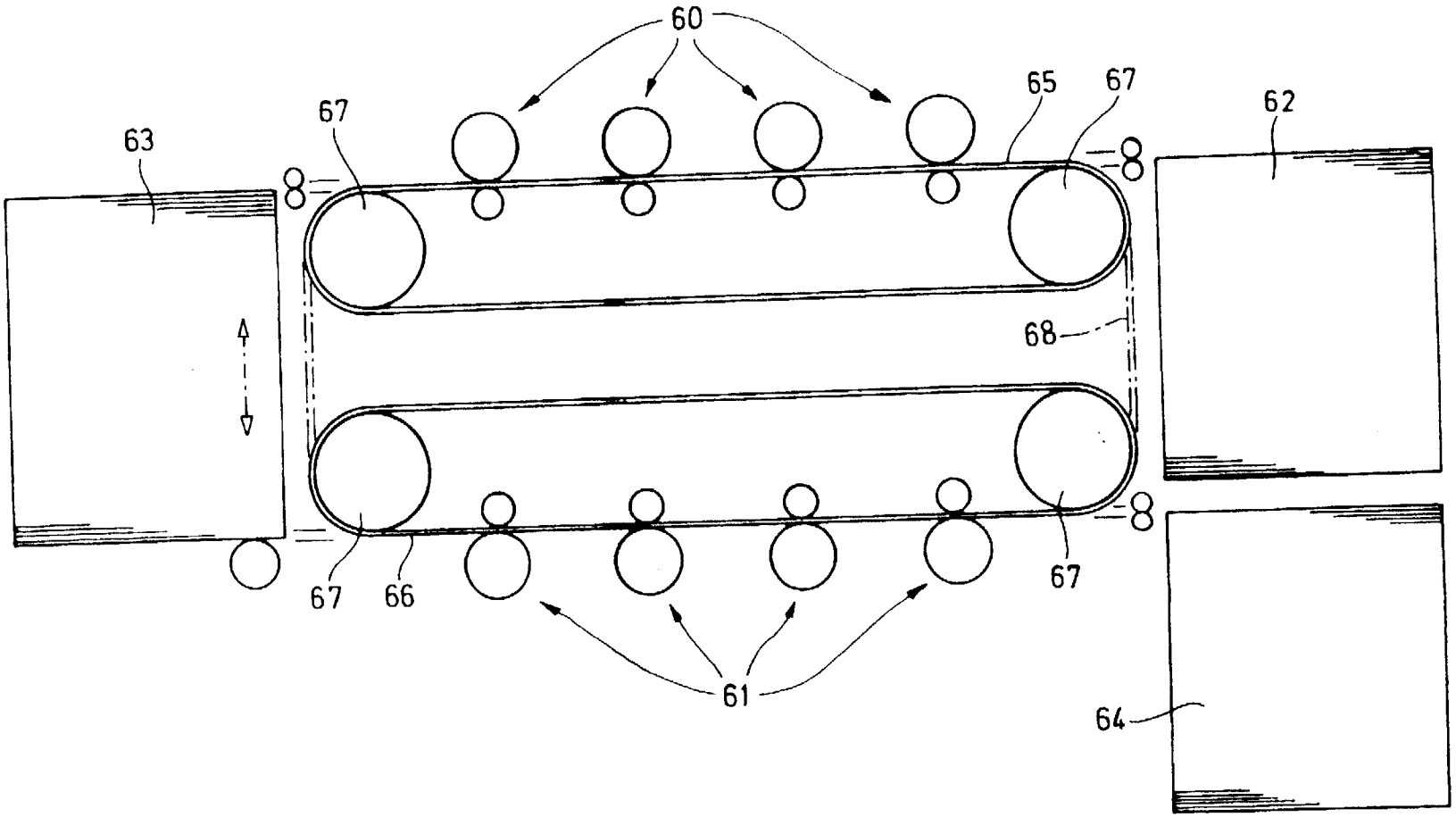
FIG. 6 is a similar view of a further variant of the printing press shown in FIG. 4.

In the printing press shown schematically in FIG. 6, upper printing units 60 for recto printing, lower printing units 61 for verso printing, a feeder pile 62, a pile 63 for delivery in recto-printing mode and a delivery pile 64 for recto-and-verso printing mode are disposed essentially in the same manner as the corresponding elements in FIG. 5.

Unlike in FIG. 5, the printing press system of FIG. 6 has two separate conveyor belts 65 and 66, instead of the single conveyor belt 50. The upper conveyor belt 65 effects sheet transport from the feeder pile 62 to the pile 63 and the lower conveyor belt 66 effects sheet transport from the pile 63 to the delivery pile 64, each conveyor belt 65 and 66 running around two respective rollers 67.

The upper conveyor belt 65 and the lower conveyor belt 66 extend parallel to and at a distance from each other, and the lower conveyor belt 66 is vertically adjustable together with the printing units 61 and the delivery, on which the pile 63 is formed. The feeder pile 62 can then be replaced without stopping the operation of the lower printing units 61 in that the pile 63, the lower conveyor belt 66 and the lower printing units 61 are moved vertically according to the reduction in the size of the pile 63. Alternatively, the delivery pile 64 can be removed without stopping the upper printing units in that those elements are moved according to the increase in size of the pile 63.

In some cases, it may be advantageous if the pile 53 is height-adjustable independently of the lower conveyor belt 66. If the upper side of the pile 63 is brought to the same height as the transport plane of the lower conveyor belt 66, then the piled sheets for verso printing can be removed from the upper side instead of from the lower side of the pile 63. The same is possible with the above-described embodiment in FIG. 5.

Instead of the upper and lower conveyor belts 65, 66, it is also possible alternatively to employ just one conveyor belt 68, which is guided around all four rollers 67, as is indicated by the broken line in FIG. 6. In this case, the height of the pile 63 remains constant, with the result that operation is identical to that of the printing press shown in FIG. 5.

As becomes apparent from FIG. 3 to 6, in all the cases shown, the sides of the feeder pile and of the delivery pile, from which the sheets are, respectively, removed and onto which they are delivered from the conveyor belt, and, where applicable, the input and output points of the turning apparatus 47 or the sides of the piles 53, 62 for intermediate storage are in alignment with the corresponding transport planes of the conveyor belts. Consequently, the entire transport path between two piles is rectilinear and the sheets are not deformed at any point on the transport path. Accordingly, the embodiments shown in FIGS. 3–6 are particularly suited for the printing of materials that cannot or should not be deformed, such as sheet metal, glass etc. In this case, the term "sheet" should, of course, be understood to mean not only paper sheets, but also substrates made of other printable materials. Moreover, the embodiments shown in FIGS. 4–6 make it possible for such substrates to be printed on both sides without being removed.

Figure 7:
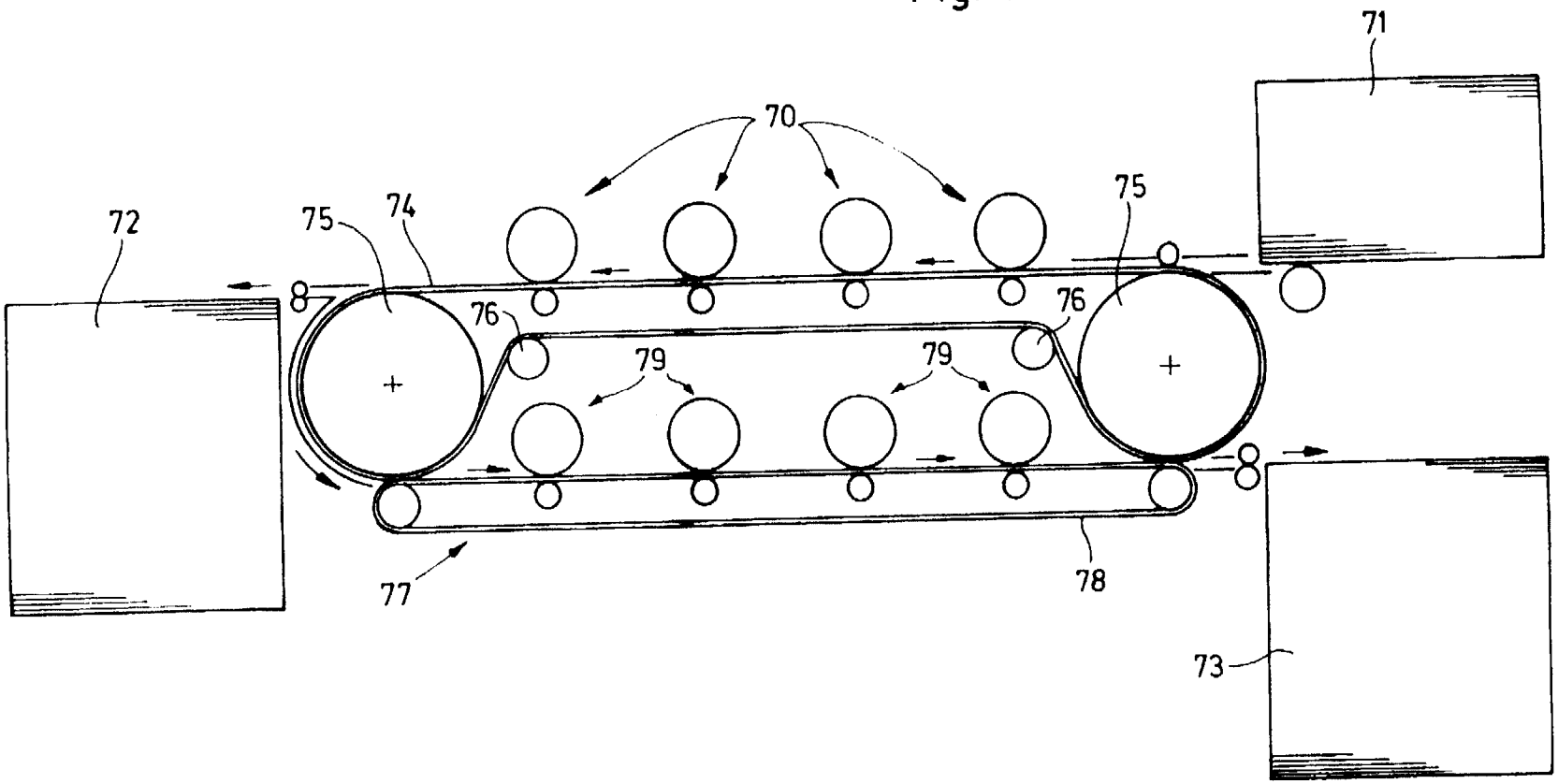
FIG. 7 is a similar view of another variant of the printing press shown in FIG. 4.

Referring now to FIG. 7, there is shown a printing press in which four upper printing units 70 for recto printing, a feeder pile 71, a pile 72 for delivery in recto-printing mode and a delivery pile 73 for recto-and-verso printing mode are disposed basically in the same manner as the corresponding elements in FIG. 6. The upper printing units 70 are passed by an upper conveyor belt 74, which is deflected around two rollers 75 of relatively large diameter. Two idler rollers 76 of small diameter are held between the rollers 75 for holding the lower side of the upper conveyor belt 74 parallel to and at a considerably smaller distance from the upper side of the conveyor belt 74 than the diameter of the rollers 75.

This results in a free space between the rollers 75 and below the upper conveyor belt 74 which is used for a verso printing unit 77 of modular construction that can be removed as a whole. The verso-printing unit 77 comprises a lower conveyor belt 78 and four in-line lower printing units 79 for verso printing. The lower conveyor belt 78 contacts the upper conveyor belt 74 at respective points on the circumferences of the rollers 75.

A non-illustrated diverter at one end of the upper conveyor belt 74 in the vicinity of the pile 72 directs the sheets (transported on the upper conveyor belt 74) in recto-printing mode onto the pile 72, while, in recto-and-verso printing mode, it allows the sheets to adhere to the upper conveyor belt 74, from which, after deflection around the left-hand roller 75, the sheets are transferred, at the point of contact with the lower conveyor belt 78, to the lower conveyor belt 78. At that point the conveyor belt 78 transports the sheets through the lower printing units 79 towards the delivery pile 73, as is indicated by arrows.

In the printing presses shown in FIGS. 4–7, it is possible to employ not only digital printing units, as in the specimen embodiments in FIG. 1 to 3, but basically any kind of printing unit, for example offset printing units. Since, in FIGS. 4–7, each two of the total of eight printing units are disposed one above the other, it is possible in all the examples shown to achieve small overall lengths.

Figure 8:
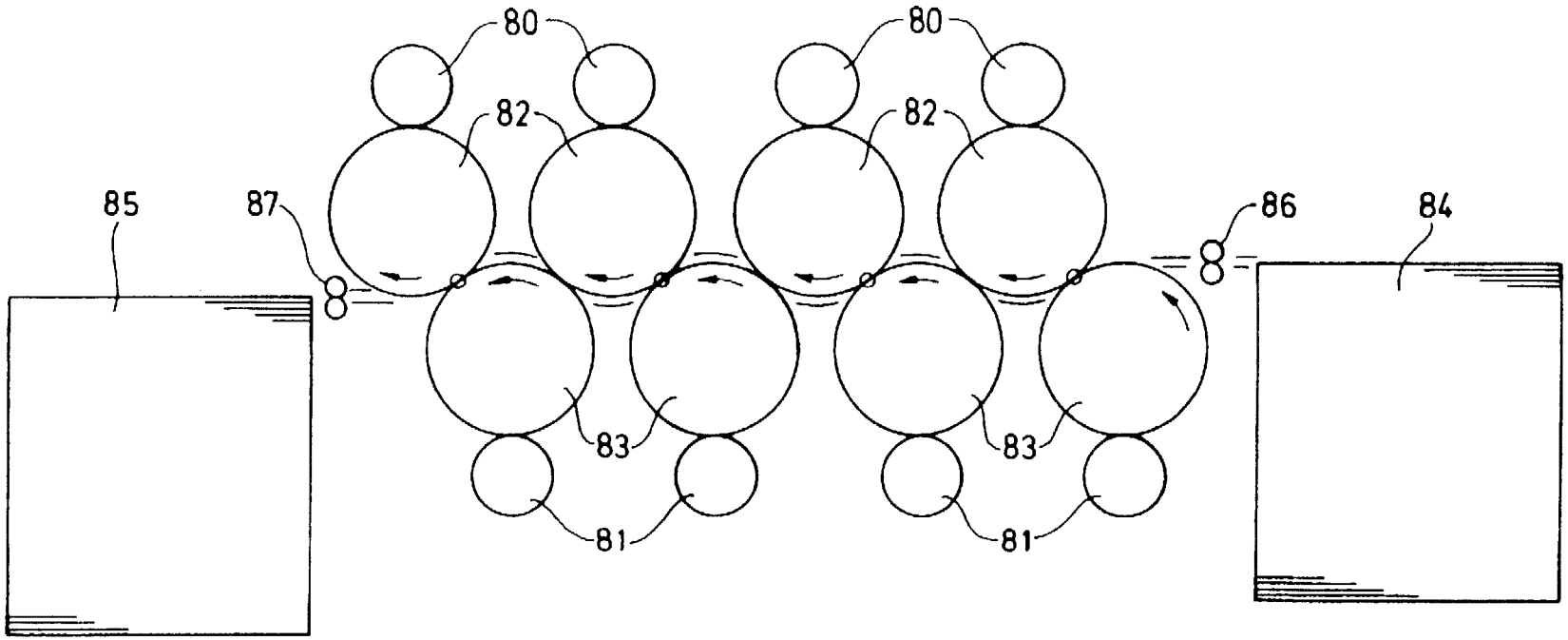
FIG. 8 is a schematic side view of a further embodiment of a printing press for four-color recto-and-verso printing with eight printing units.
Figure 9:
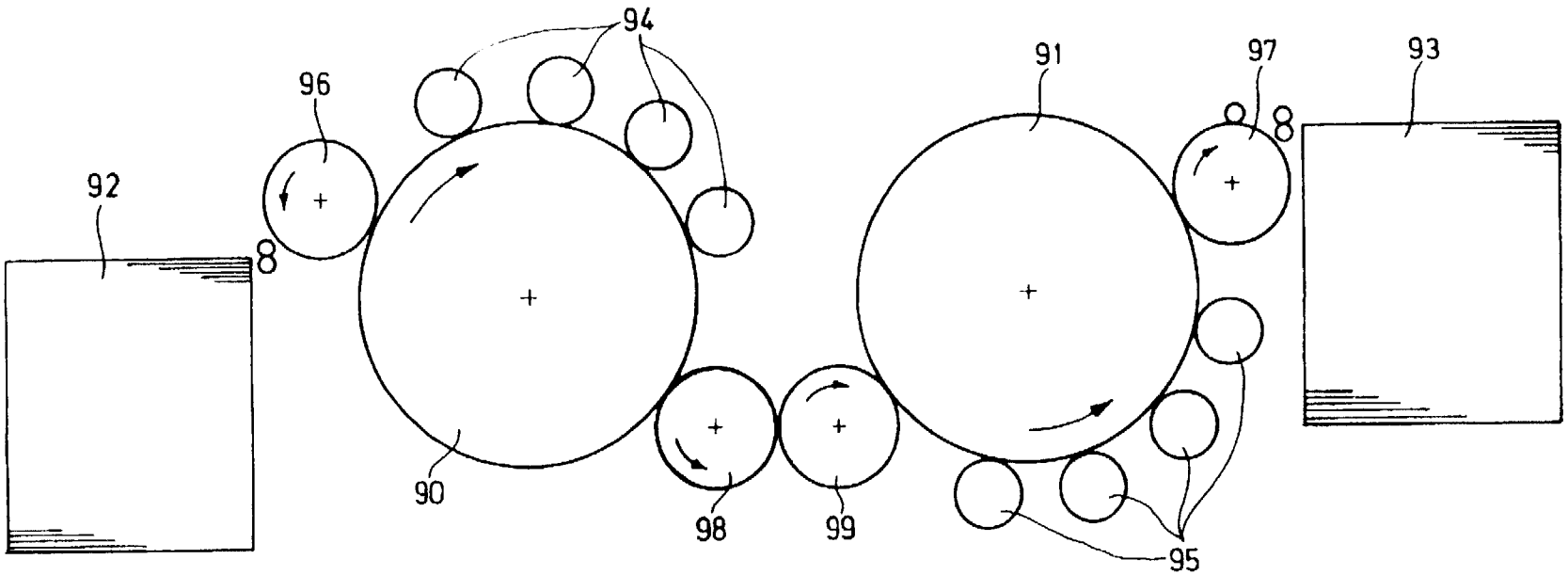
FIG. 9 is a schematic side view of again a further embodiment of a printing press for four-color recto-and-verso printing with eight printing units.

Furthermore, the exemplary embodiments shown in FIG. 8 and FIG. 9 are suitable for the construction of a compact printing press for recto-and-verso printing. The printing press of these embodiments has printing units comprising transfer cylinders or impression cylinders.

The printing press shown schematically in FIG. 8 comprises eight printing units with four upper and four lower impression cylinders 80, 81 and four upper and four lower transfer cylinders 82, 83. The upper transfer cylinders 82 and the lower transfer cylinders 83 are each disposed in a horizontal line and are spaced apart by a distance that is smaller than the cylinder diameter, and the two rows are situated one above the other, the rows being horizontally offset with respect to each other by half the center-to-center distance between the cylinders. The transfer cylinders 82 and 83 of one row contact the transfer cylinders 83 and 82 of the other row.

In other words, the eight transfer cylinders 82, 83 define a snaking zig-zag line in which each upper transfer cylinder 82 contacts the following lower transfer cylinder 83, and vice versa. The upper impression cylinders 80 are disposed above the upper transfer cylinders 82, and the lower impression cylinders 81 are disposed below the lower transfer cylinders 83.

Between the upper transfer cylinders 82 and the lower transfer cylinders 83 there is formed a snaking sheet-transport path from a feeder pile 84 to a delivery pile 85, as is indicated by arrows. Sheets from the feeder pile 85 are fed by conveying rollers 8S between the feeder-side upper transfer cylinder 82 and the feeder-side lower transfer cylinder 83 and are subsequently transported by friction between the mutually contacting transfer cylinders 82, 83 along the sheet-transport path and then via conveying rollers 87 onto the delivery pile 85.

Recto-and-verso printing is performed in one pass between the transfer rollers 82, 83, each upper transfer roller 82 forming an impression cylinder for an adjacent lower transfer roller 83, and vice versa, without special sheet-transport means being required for transport along the printing units. The zig-zag-shaped arrangement of the printing units results in a very small overall length.

The printing press shown schematically in FIG. 9 comprises two impression cylinders 90, 91 of a relatively large diameter. The impression cylinders 90, 91 are disposed axially parallel in-line between a feeder pile 92 and a delivery pile 93. Four printing units 94 for recto printing are disposed inline on the circumference of the feeder-side impression cylinder 90, and four printing units 95 for verso printing are disposed in-line on the circumference of the delivery-side impression cylinder 91. The basic sketch in FIG. 9 shows merely transfer cylinders of the printing units 94, 95, the transfer cylinders having a considerably smaller diameter than the impression cylinders 90, 91.

A transfer roller 96 is situated between the feeder pile 92 and the impression cylinder 90 for the transfer of the sheets supplied from the feeder pile 92 to the impression cylinder 90. A transfer roller 97 is situated between the impression cylinder 91 and the delivery pile 93 for the transfer of the sheets from the impression cylinder 91 to the delivery pile 93. Two further, mutually contacting transfer rollers 98 and 99 are situated between the impression cylinders 90 and 91 for the transfer of the sheets from the one impression cylinder 90 to the other impression cylinder 91.

The transfer rollers 96, 97, 98 and 99 each contact one of the impression cylinders 90, 91. The conveyed sheets are held on the surfaces of the transfer rollers 96 to 99 and of the impression cylinders 90 and 91 either by grippers, by suction or by electrostatic force and, with suitable dimensioning of the forces, they are transferred at the points of contact. The transfer rollers 98 and 99 between the impression cylinders 90 and 91 may be replaced by any other apparatus for transporting the sheets from the impression cylinder 90 to the impression cylinder 91, or, alternatively, the two impression cylinders 90 and 91 may be disposed in mutual contact, the sheets being transferred at the point of contact.

When the impression cylinders 90, 91 and the transfer rollers 96 to 99 rotate in the directions indicated by arrows, the sheets are conveyed from the feeder pile 92 between the impression cylinders 90, 91 and the respective printing units 94, 95 and transfer rollers 95 to 99 in an essentially S-shaped manner around the two impression cylinders 90, 91 to the delivery pile 93 (if one ignores the particular course of the transport path for transfer between the two impression cylinders 90, 91). The essentially S-shaped sheet-transport path, along which the printing units 94 and 95 are disposed inline, permits a short overall length of the printing press shown in FIG. 9.

Particularly suitable for the printing presses shown in FIG. 8 and 9 are digital printing units, which, moreover, are compact enough in construction for such arrangements.

All the above-described embodiments can basically also be implemented if conventional transport apparatus with chains and grippers are employed. Such conventional transport apparatus are then employed, for example, instead of the conveyor belts, to which the sheets adhere during transport.

We claim:

1. A sheet-fed printing press, comprising:

a plurality of digital printing units disposed along a sheet-transport path;

a transport apparatus disposed along the sheet-transport path, said transport apparatus transporting sheets through said printing units along the sheet-transport path and, after the sheets have been recto-printed in said printing units, returning the sheets in turned position along a return-transport path defined substantially in an opposite direction to the sheet-transport path for verso printing in the same said printing units; and a feeder for feeding sheets to said printing units, said printing units being adapted to be operated at a faster rate than said feeder.

2. The sheet-fed printing press according to claim 1, wherein said printing units are recto printing units, and including further printing units for verso printing disposed along the return-transport path.

3. The sheet-fed printing press according to claim 1, wherein said transport apparatus consists essentially of a single transport apparatus transporting the sheets along the sheet-transport path and along the return-transport path.

4. The sheet-fed printing press according to claim 1, wherein said transport apparatus comprises a sheet-transport apparatus transporting the sheets along the sheet-transport path, and a return-transport apparatus, separate from said sheet-transport apparatus, for returning the sheets along the return-transport path.

5. The sheet-fed printing press according to claim 1, wherein said transport apparatus defines the sheet-transport path and the return-transport as substantially rectilinear paths extending approximately parallel at a distance from one another.

6. The sheet-fed printing press according to claim 1, wherein said printing units include transfer cylinders with a given diameter for transferring printed images onto the sheets, said transfer cylinders including a first row of transfer cylinders for recto-printing on one side of the sheets, said transfer cylinders of said first row of transfer cylinders being disposed in-line and mutually spaced apart by a distance smaller than said given diameter, and a second row of transfer cylinders for verso-printing another side of the sheet, said transfer cylinders of said second row of transfer cylinders being disposed in-line and mutually spaced apart by a distance smaller than the given diameter, said first and second rows being offset relative to one another and each transfer cylinder of said first row contacting at least one said transfer cylinder of said second row.

7. The sheet-fed printing press according to claim 1, which comprises two impression cylinders, said impression cylinders having a substantially larger diameter than transfer cylinders of said printing units, a plurality of said plurality of printing units being disposed in-line at a circumference of each of said two impression cylinders, the sheet-transport path being defined between said printing units and a respective said impression cylinders and extending substantially along an S-shaped path around said impression cylinders.

8. A sheet-fed printing press, comprising:

a plurality of printing units disposed along a sheer-transport path;

a transport apparatus disposed along the sheet-transport path, said transport apparatus transporting sheets through said printing units along the sheet-transport path and returning the sheets along a return-transport path defined substantially in an opposite direction to the sheer-transport path, and a turning apparatus disposed at a junction of the sheet-transport path and the return-transport path; and a feeder for feeding sheets to said printing units, said printing units being adapted to be operated at a faster rate than said feeder.

9. A sheet-fed printing press, comprising:

a plurality of printing units disposed along a sheer-transport path;

a transport apparatus disposed along the sheet-transport path, said transport apparatus transporting sheets through said printing units along the sheet-transport path and returning the sheets along a return-transport path defined substantially in an opposite direction to the sheer-transport path, and an inspection-sheet receiver disposed along the return-transport path; and a feeder for feeding sheets to said printing units, said printing units being adapted to be operated at a faster rate than said feeder.

* * * * *